United States Patent [19]

Edwards

[11] Patent Number: 5,076,582

[45] Date of Patent: Dec. 31, 1991

[54] BOWLING BALL LIFTING APPARATUS

[75] Inventor: Garland U. Edwards, Chesterfield, Va.

[73] Assignee: AMF Bowling, Inc., Richmond, Va.

[21] Appl. No.: 559,089

[22] Filed: Jul. 30, 1990

[51] Int. Cl.[5] ..... A63D 5/02

[52] U.S. Cl. ..... 273/49; 273/48

[58] Field of Search ..... 273/37, 42 R, 43 R, 273/43 D, 43 E, 47, 48, 49, 54 R

[56] References Cited

U.S. PATENT DOCUMENTS

| | | | |
|---|---|---|---|
| 2,765,172 | 10/1956 | Zuercher et al. | 273/49 |
| 2,994,532 | 8/1961 | Fitzgerald | 273/43 |
| 3,065,965 | 11/1962 | Cervetti | 273/43 |
| 3,068,006 | 12/1962 | Holloway | 273/49 |
| 3,201,123 | 8/1965 | Ernst | 273/43 |
| 3,240,493 | 3/1966 | Cohen | 273/54 |
| 3,297,322 | 1/1967 | Ernst et al. | 273/43 |
| 4,226,417 | 10/1980 | Camilleri | 273/43 R |
| 4,509,752 | 4/1985 | Schmid | 273/49 |

*Primary Examiner*—Edward M. Coven
*Assistant Examiner*—William M. Pierce
*Attorney, Agent, or Firm*—Bacom & Thomas

[57] ABSTRACT

A mechanism for lifting bowling balls from the pit area of a bowling alley to a ball return runway at or above the level of the bowling alley includes a ball elevator mechanism in which a bowling ball is moved upwards along a track by frictional engagement with a conveyor belt. The conveyor belt is driven by two pulleys mounted on a support rod which is itself pivotal about a rolling pivot in response to an eccentric cam arrangement which moves the lower pulley away from the track in order to provide clearance for the ball, and then moves the lower pulley towards the track so that the belt securely engages the ball and moves it up the track. An oscillating paddle is driven by a spherical cam arranged on a speed reduction pulley which also drives the eccentric cam arrangement so that the paddle and elevator mechanism move in synchronism via a common drive.

17 Claims, 5 Drawing Sheets

BOWLING BALL LIFTING APPARATUS

BACKGROUND OF THE INVENTION

1. Field of the Invention.

The invention relates to the handling of bowling balls, and in particular to an apparatus adapted for removing a bowling ball from the pit behind a bowling alley and lifting the ball along a track to an elevated point of discharge for return via a bowling ball runway to the approach end of the bowling lane.

2. Description of Related Art.

A conventional bowling pin and ball handling apparatus is described in U.S. Pat. No. 3,297,322. This type of apparatus has found widespread use in commercial bowling establishments and includes mechanisms for retreiving both pins and bowling balls from pits behind the bowling alleys, for spotting the pins, and for returning the balls to bowlers at the approach ends of the alleys.

Balls leave the pits via openings or doors provided in kickbacks of the bowling alleys. Upon leaving a pit, the ball to be returned moves into the range of operation of a bowling ball lifting or elevating mechanism, such as an endless belt and track combination, which lifts the ball to a runway or return race. The runway is inclined so that the ball rolls down the incline towards the approach end of the lane, where the ball is braked and lifted up to a level at which the bowler can conveniently reach it.

The conventional ball elevating mechanism includes a frame and an endless conveyor belt running between two pulleys mounted on a supporting member. The supporting member is itself supported by levers and can swing upwardly and away from the track to provide clearance between the belt and the track. In order to cause initial engagement of the ball by the conveyor belt once the ball has arrived in the vicinity of the belt and the belt is in a lifting position, kicker rollers are required to lift the ball into a position in which it may be engaged by the belt.

When the ball elevating mechanism is shared by two alleys, a mechanism is necessary for preventing balls from moving through the openings from the pits simultaneously. The conventional ball handling apparatus uses a paddle which is pivotal between openings to permit only one ball at a time from entering the elevator, and to prevent pins from entering.

In order to operate properly, the ball handling mechanism must be arranged to compensate for balls having weights generally ranging from ten to sixteen pounds, while rejecting stray pins, which weigh less than four pounds. As a result, the paddle drive and kicker rollers require pressure sensitive mechanisms, each of which must fit into a space approximately the width of the bowling ball.

While such mechanisms have proven to be remarkably effective, the mechanisms involved are nevertheless relatively complicated and therefore, inevitably, a source of mechanical breakdowns. Because of the limited space available between alleys, and the complexity and large number of parts used in such devices, repairs can be difficult and the time required to effect repairs may significantly reduce the amount of time an alley is available for bowling.

SUMMARY OF THE INVENTION

It is an objective of the invention to provide a bowling ball lifting mechanism of improved efficiency and reliability, which uses less parts than conventional lifting mechanisms, and yet is just as effective as conventional mechanisms at separating pins and expeditiously returning the ball to the bowler.

This objective is achieved by providing a bowling ball handling apparatus of the type which includes a transport belt for frictionally engaging a bowling ball and lifting it up along a track. The two pulleys which drive the belt are mounted on opposite ends of an elongated support member.

An eccentric cam mechanism causes the elongated member to pivot about a rolling pivot, moving the pulleys away from and towards the track in generally elliptical paths, to provide clearance for an incoming ball and to subsequently cause the belt to engage the ball, without the need for either a ball kicker roller mechanism or a complex lever-based supporting structure.

The eccentric cam member is mounted on a pulley which is driven by a large diameter transmission pulley to form a speed reduction transmission mechanism. The second pulley is provided with a second eccentric cam for driving a paddle in synchronism with movement of the first eccentric cam.

The large diameter transmission pulley is driven by a pulley provided on one of the conveyor belt pulleys such that the elevator belt, elevator cam mechanism, and paddle may all be synchronously driven by a common motor in a simple and efficient manner, with a minimum total number of belts, gears, pulleys, levers, and other mechanism parts.

In keeping with the objective of reducing the complexity and number of parts required, a simplified elevator belt tensioning mechanism using a pin and slot mounting arrangement is also provided.

A final objective of the invention is to provide an improved ball handling mechanism that, while reducing the overall number of parts does not require, wholesale reconstruction of the conventional ball and pin handling apparatus. For example, in a preferred embodiment of the invention, both a paddle drive clutch mechanism and the ball elevator track are conventional and require no substantial modification.

DESCRIPTION OF THE PREFERRED EMBODIMENT

FIGS. 1-5 show various aspects of a ball handling mechanism according to a preferred embodiment of the invention. It will of course be appreciated that the following description is intended to be exemplary rather than limiting, and that numerous variations are possible which will still be within the scope of the invention.

The bowling ball lifting mechanism embodied by the apparatus shown in FIGS. 1-5 can be used with any type of bowling pin spotting machine or bowling installation in which the kickback of a bowling lane is provided with an opening or ball door through which a ball may roll out of the pit and into the range of operation of a bowling ball elevating mechanism, and which subsequently effects return of the ball along a bowling ball return runway to the approach end of the bowling lane.

One such device is the ball handling mechanism of U.S. Pat. No. 3,297,327, herein incorporated by reference. The paddle and elevator drive mechanisms, and the track utilized in the preferred embodiment, are essentially identical to those of U.S. Pat. No. 3,297,322, except as noted below. However, it is to be understood that the invention may be applied to numerous other ball elevating mechanisms of the type employing an endless belt and track to elevate the ball.

Figure 5:
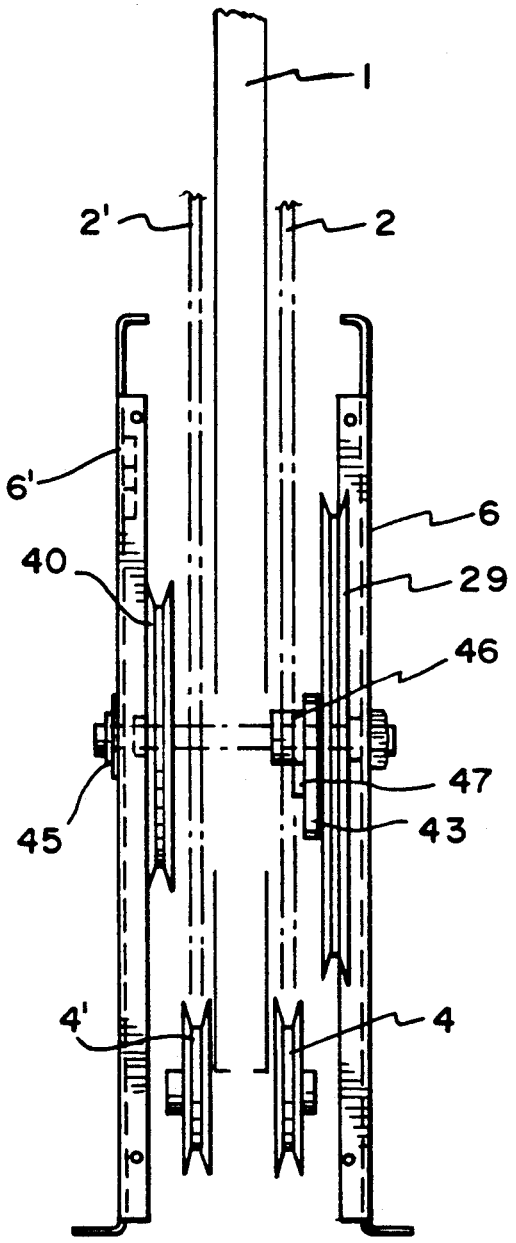
FIG. 5 is a sectional front view of the preferred ball handling apparatus taken on line 3—3 of FIG. 1.

All of the elements of the invention are provided between two frame members 6 and 6', as is best shown in FIG. 5. Frames 6 and 6', and all of the additional structure shown in the drawings, fit within the space provided between the pits of two adjacent bowling alleys. For purposes of clarity, only a single frame 6 is shown in the sectional side elevations of FIGS. 1-4. It is to be understood, however, that frame 6' is essentially a duplicate of frame 6.

Frame 6 includes a ball opening 50, through which balls leave the pit and enter into the range of operation of the bowling ball elevating mechanism. Frame 6' also includes a ball opening (not shown) located symmetrically in respect to opening 50. Entry through the ball openings is controlled by a paddle mechanism, to be described below.

A V-shaped track 18 is provided for guiding the bowling ball from opening 50 or from the opening in frame 6' into a position adjacent the elevator, which includes an endless belt 2 and track 7. Belt 2 rolls the bowling ball up track by frictional engagement between the ball and the belt. Thus, it is essential that pressure be applied by the belt supporting mechanism to maintain firm contact between the belt and the ball.

As it initially leaves the pit through opening 50 or the opening in frame 6', the ball must clear belt 2. In order to accomplish this in an especially simple manner, an eccentric pivot or cam mechanism is provided which causes the entire elevator pulley and belt structure to execute a compound pivoting movement, permitting belt 2 to clear the ball when it is on V-shaped track 18, and subsequently causing belt 2 to engage the ball in order to move the ball up the track to the ball return runway at the top of the elevator.

Track 7 defines a generally S-shaped curvilinear pathway with a lower essentially horizontal ball receiving portion which intersects a portion of V-shaped track 18 such that when the ball comes to rest on track 18, it is also positioned on track 7 for movement upwardly along an upwardly extending linear race portion of the track. The uppermost portion of track 7 is curved such that the ball is discharged onto a ball return runway upon reaching this portion of the track.

Belt 2 is moved and supported by two pulleys 3 and 4 which rotatably mounted on an elongated support member 1. Support member 1 includes a tensioning mechanism 5 for biasing the rollers 3 and 4 away from each other, thereby tensioning the conveyor belt, and is preferably generally tubular in construction.

As is best shown in FIG. 5, an additional belt 2' and pulleys 3' and 4' are provided on support member 1. For purposes of simplicity, however, only rollers 3 and 4 and belt 2 will be referred to in the following discussion.

Both rollers 3 and 4 are connected only to elongated support member 1, and are free to move with the support member. It will be appreciated that belt 2' and rollers 3' and 4' are identical to belt 2 and rollers 3 and 4, respectively, and are symmetrically mounted in respect thereto on support member 1. It will further be appreciated that a dual belt and pulley structure is not required and that a single pulley and belt system will also accomplish the purposes of the invention.

The eccentric pivoting mechanism includes an eccentric pivot shaft 9 which is mounted to frame member 6. A cam driving pulley 10 is coaxially mounted on the eccentric pivot shaft 9 and a cam member 11 is eccentrically mounted on pulley 10. Pulley 10 is driven via a belt 41 by a mechanism to be described below, in turn causing cam member 11 which is mounted thereto to rotate eccentrically about shaft 9.

In order to transmit motion from cam member 11 to the elevator belt assembly, a bracket 12 mounted on elongated support member 1 includes a bearing sleeve 13 which follows the eccentric motion of cam member 11. Cam member 11 is mounted to fit within bearing sleeve 13 such that, as cam member 11 rotates about shaft 9, sleeve 13 and bracket 12 follow an eccentric path having a center at the axis of shaft 9 and a radius equal to the distance between the center of shaft 9 and a point on the circumference of cam member 11 farthest away from the shaft axis. Although the sleeve and cam structure described herein is preferred, it is intended that other eccentric structures may be substituted in order to provide the motion to be described.

Elongated support member 1 is supported by both bracket 12 and a rolling pivot 8 which is fixed to frames 6 and 6'. As a result, the entire pulley assembly executes a compound pivoting movement about the rolling pivot 8, the eccentric cam member driving the lower portion of the support member in a generally eliptical movement, such that pulleys 3 and 4 move in a cyclical path towards and away from track 7. A bracket (not shown) prevents the support member 1 from moving or rolling laterally in respect to the pivot 8.

Bowling balls are caused to enter the elevator through an opening 50 in frame member 6 and the corresponding symetrically arranged opening in frame member 6' when the pulley 4 has been moved to a position away from track 7. After a bowling ball has entered the elevator and come to rest on V-shaped track 18, pulley 4 moves toward track 7, causing belt 2 to engage the bowling ball. The continuous movement of belt 2 in a counter-clockwise direction about pulleys 3 and 4 causes the ball to be rolled up the track.

By the time the ball is approximately half-way up the track, pulley 4 has moved away from track 7, and pulley 3 has moved towards the track by virtue of the rolling pivot 8, maintaining engagement between belt 2 and the ball and causing the ball to complete its upward movement and be delivered to the return runway at the top of track 7.

Bracket 12 and pivot 8 are together sufficient to position the elevator assembly, thus eliminating the need for lever-based-pulley support mounting assemblies and kicker mechanisms, required in conventional bowling ball elevators for moving the ball upward a sufficient distant to engage the belt. Thus, the present invention achieves far greater efficiency and reliability due to the smaller number of parts required, than was possible with conventional mechanisms.

Figure 1:
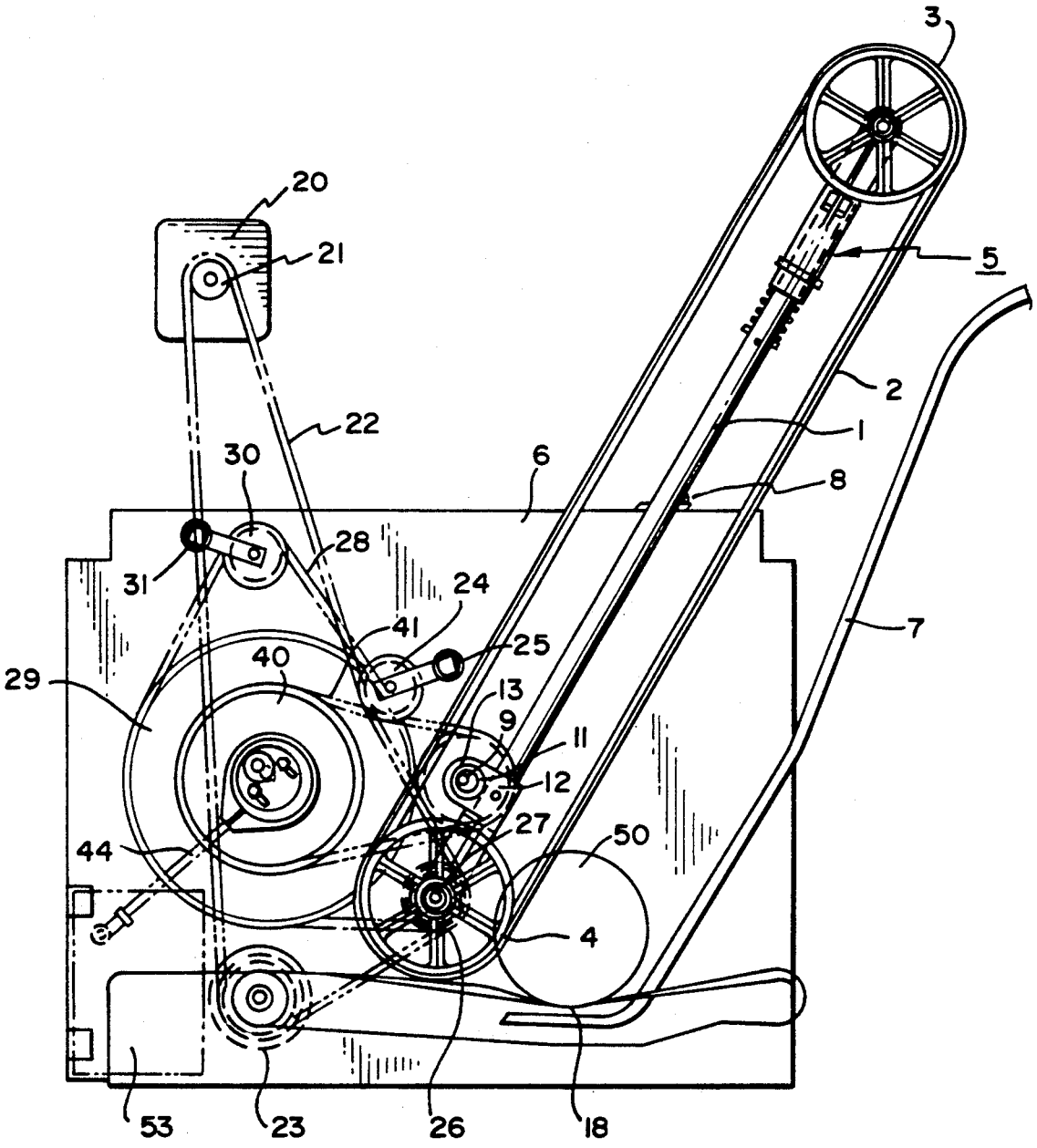
FIG. 1 is a sectional side elevation illustrating bowling ball handling apparatus according to a preferred embodiment of the invention.

Belt 2 and cam driving pulley 10 are driven as follows: pulley 4 is driven by a drive belt 22 via pulley 23 and motor pulley 21. Motor 20 turns in a counter-clockwise direction to drive pulley 4 in a counter-clockwise direction as shown in FIG. 1, thus moving belt 2 in the direction of ball elevation. A roller 34 biased by spring 35 ensures engagement between pulley 26 and belt 22 as pulley 4 executes its eccentric movement in response to driving of cam member 11. Pulley 4 carries an outer pulley 26 driven directly by belt 22 and an inner pulley 27 which drives a transmission belt 28.

Transmission belt 28 is arranged to drive a first transmission pulley 29 via bias pulley 30, which is biased by a coil spring 31 to maintain tension on belt 28 and ensure that belt 28 engages drive pulley 27. Together, pulley 27 and pulley 29 constitute a speed reduction mechanism for converting the rotation of drive pulley 4 into a much slower rotation of cam drive pulley 10 which carries cam member 11 and therefore drives the elevator pivoting mechanism.

Pulley 10 is driven directly via a belt 41 by second transmission pulley 40 on first transmission pulley 29, and has a smaller diameter than first transmission pulley 29. Because of the relative diameters of pulley 27, pulley 29, and pulley 40, pulley 4 will rotate several times for each rotation of cam drive pulley, thus synchronizing movement of the elevator belt 2 and cam member 11. Roller 24, biased by spring 25, is provided to tension 41.

Figure 2:
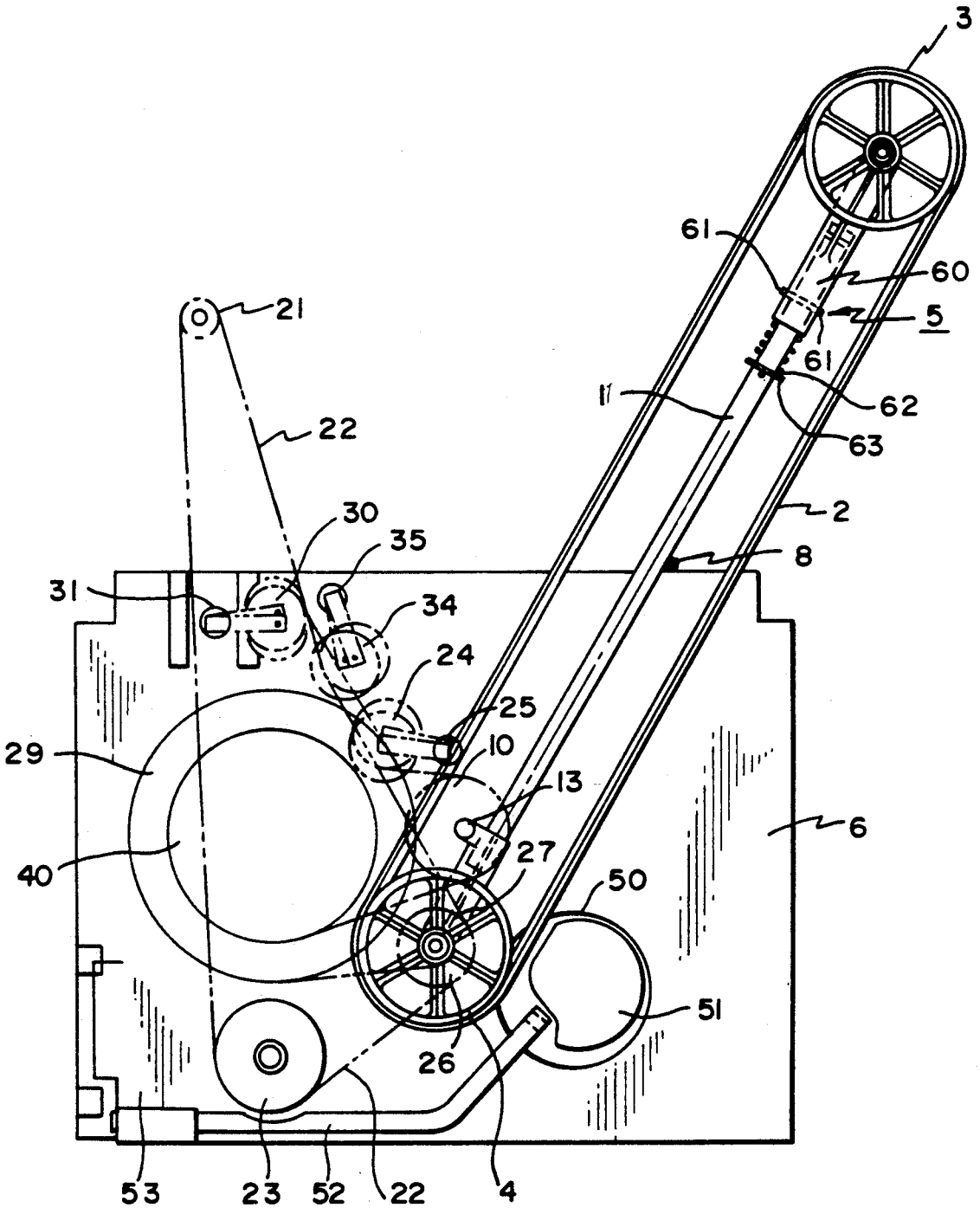
FIG. 2 is a second sectional side elevation illustrating further aspects of the preferred embodiment of the invention.

As shown in FIG. 2, a paddle 51 fits within the circumference of ball opening 50. Paddle 51 is connected to support rod 52 which is pivotal about a vertical axis within ball sensor mechanism 53. Except for the manner in which the paddle is driven, ball sensor mechanism 53 and paddle 51 form no part of the invention. A suitable paddle mechanism including a light ball sensor is described in U.S. Pat. No. 3,927,322, incorporated herein by reference. Paddle 51 normally oscillates repeatedly in a pivotal motion from opening to opening in response to rotation of pulley 29 as explained below.

Support rod 52 is rotated about a horizontal axis extending parallel to frame member 6 and 6' via a dash pot in such a manner that it pivots paddle 51 between the respective openings in frame 6 and 6' to prevent pins from entering the elevator through the openings and to prevent simultaneous entry of balls through the two openings. When a ball enters either of the openings, paddle 51 is pushed against the opening opposite the one through which the ball has entered. An over-center spring mechanism including the dash pot biases the paddle whichever opening it is covering so that a light ball will not be pushed out of the way by an incoming heavy ball.

The light ball sensor is essentially a clutch which causes the weight of a ball to overcome the driving force which normally causes the paddle to oscillate and prevent objects from entering the elevator area. The over-center spring arrangement provides sufficient force to assist a light ball in holding the paddle against the opening to prevent a heavier ball from entering. On the other hand, the paddle driving force must be sufficiently strong to overcome the over-center spring biasing force which biases the paddle towards either of the two openings.

In conventional ball lifter mechanism, the paddle is driven by a crank pin provided on a separate pulley. The present invention replaces the crank and separate pulley with a spherical cam 43 mounted on pulley 29, further reducing the number of parts required without necessitating replacement of the entire light ball sensor and paddle drive assembly.

Figure 3:
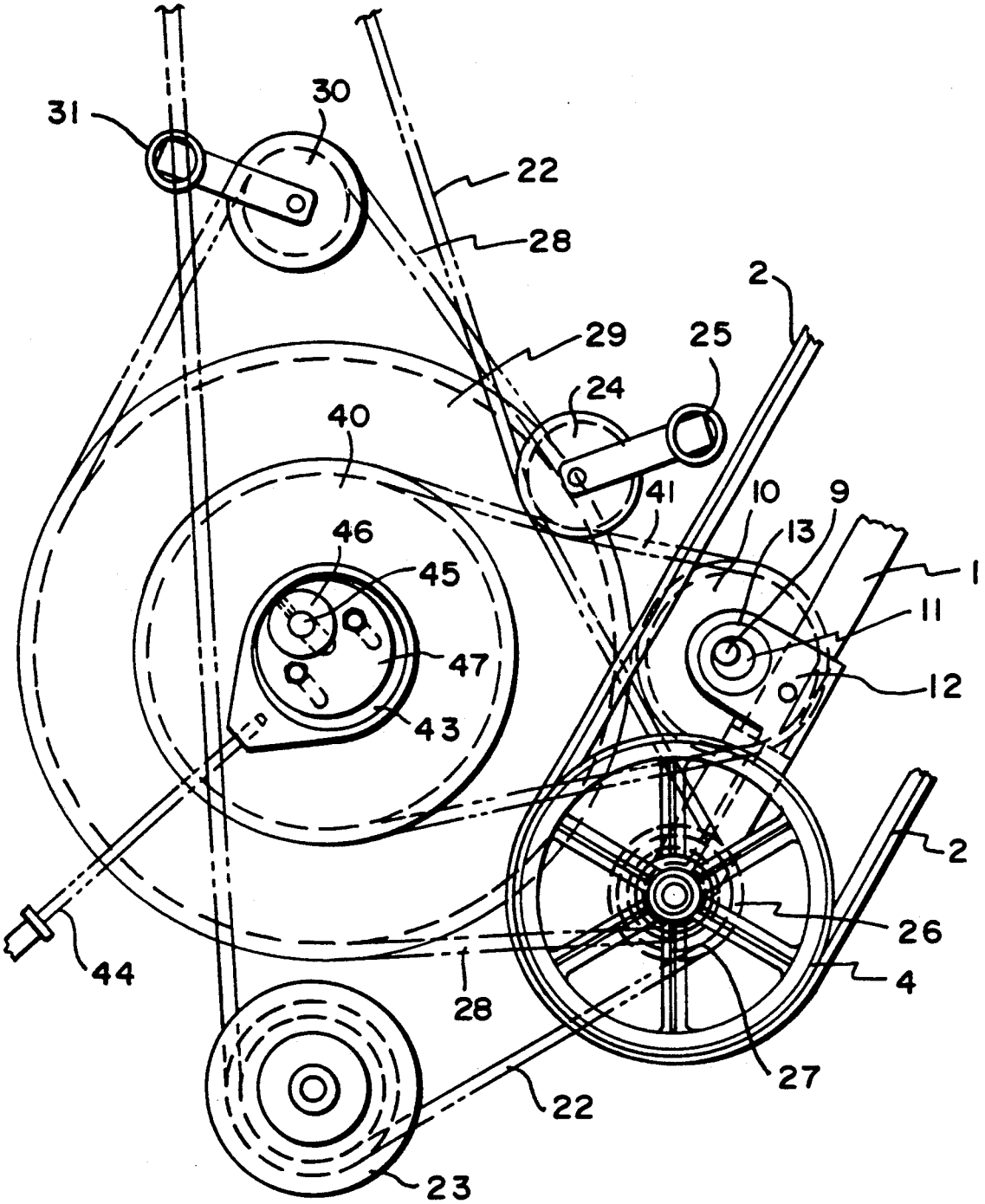
FIG. 3 is an enlarged sectional side elevation showing the elevator cam mechanism and a paddle drive cam mechanism according to the preferred embodiment of the invention.
Figure 4:
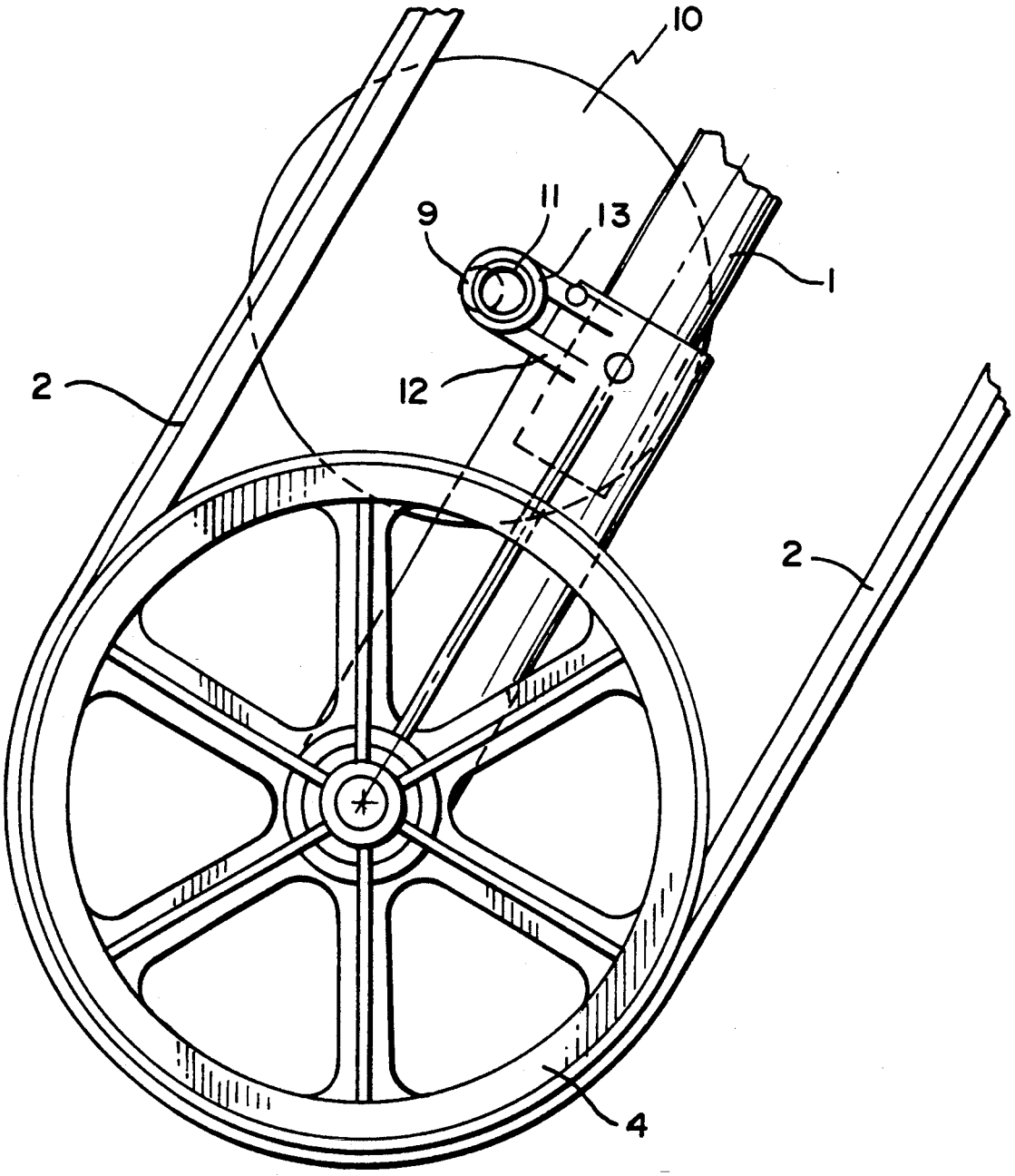
FIG. 4 is an enlarged sectional side elevation showing in further detail the elevator cam mechanism of the preferred embodiment of the invention.

As shown in FIG. 3, a cam follower 44 extends from the light ball mechanism to spherical cam 43. First and second transmission pulleys 29 and 40 rotate around a shaft 45 mounted to frames 6 and 6' on which is placed cam 43 and a retaining ring 46. The position of spherical cam 43 is preferrably made adjustable by providing an adjustment plate 47, to which the cam is mounted and which is slidable in respect to the transmission pulleys.

Spherical cam 43 converts the circular motion of second transmission pulley 40 into a linear motion of follower 44 in the axial direction of follower 44. The linear motion is then converted by the ball sensor dash pot into the oscillating motion of paddle 51. The latter motion conversion is the same as provided by the conventional light ball sensor and dash pot mechanism as described above except that, by placing the spherical cam on pulley 29, oscillation of paddle 51 is perfectly synchronized with rotation of elevator belt 2 and the pivoting of the elevator support. By using a spherical cam instead of a crank mechanism, the motion of follower 44 is made completely linear, thus increasing efficiency and accuracy.

Figure 6:
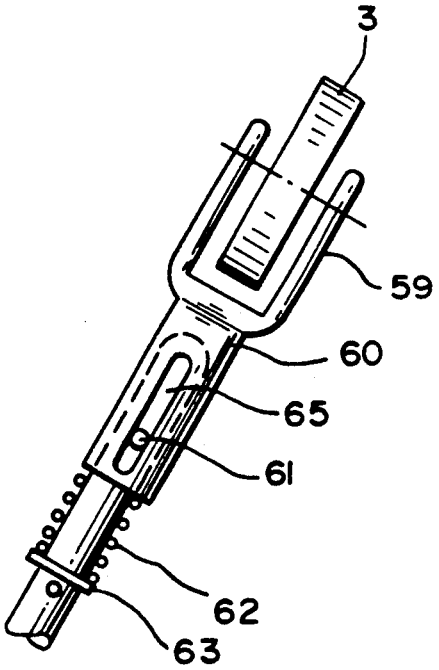
FIG. 6 is a sectional view of a ball elevator belt tensioning mechanism according to the preferred embodiment of the invention.

The preferred embodiment also includes an optional improved elevator belt tensioning mechanism. FIG. 6 is a sectional view taken along line 2—2 in FIG. 1 of the improved elevator belt tensioning mechanism 5. Pulley 3 is mounted on a fork member 59 including a sleeve 60 which fits over an inner member formed by a portion of elongated support member 1 and is held in position by pins 61 on the support member. Pins 61 are slidably disposed in a pair of opposed longitudinal passages 65 in sleeve 60 which are closed at each end to retain the pins and confine the relative axial movement of sleeve 60 and the inner member. A coil spring 62 extends between sleeve 60 and a collar 63 provided on the support member 1, biasing the sleeve 60 in the direction of maintaining tension on the pulley.

In order to operate the bowling ball lifter of the preferred embodiment, motor 20 is started to drive belts 22, 28, and 41 in a counter-clockwise direction about the respective pulleys. Pulley 4 turns continuously to drive belt 2 in a counter-clockwise direction. Because of the action of eccentric cam member 11, pulleys 3 and 4, together with elongated support member 1, execute a compound pivoting motion about rolling pivot 8 with each pulley executing a substantially eliptical motion such that, as pulley 4 rotates to drive belt 2, pulley 4 moves downward and towards track 7, and subsequently upwards and away from track 7.

At the same time, paddle 51 swings between opening 50 and a corresponding opening in frame 6' in response to the turning of spherical cam 43 provided on second transmission pulley 40. Because of the relative diameters of cam 43, first transmission pulley 29, and pulley 26, which drives pulley 29, oscillation of paddle 51 occurs relatively rapidly in relation to pivoting of the elevator mechanism, causing the paddle to sweep back and forth between openings at a fast enough rate to prevent any stray pins from entering the elevator mechanism.

When a ball encounters paddle 51 as it passes through opening 50 or the corresponding opening in frame 6', paddle 51 is pushed towards the opposite opening and prevents balls from entering through the other opening with the aid of the over-center spring in the ball sensor 53. At this time, the driving force provided by cam 43 ceases to be transmitted to the paddle. As soon as the ball comes to rest on grooved track 18, pulley 4 is moved towards track 7 causing drive belt 2 to engage the ball and begin to roll it up the track.

When the ball has passed the approximate position of the rolling pivot, pulley 3 begins its motion towards the track, keeping the ball engaged in further moving it up the runway. At this time pulley 4 moves away from the track and paddle 51 is again caused to oscillate under the impetus of rotating spherical cam 43, and the elevator is positioned to accept another ball from the pit through one of the two openings in frames 6 and 6' respectively.

Thus, the invention provides an especially efficient mechanism for accepting and elevating balls from the pit area of a bowling alley while using a minimum number of parts. Although the invention has been described above in reference to a specific embodiment, it is likely that numerous variations of the invention will occur to those skilled in the art, and it is therefore intended that the scope of the invention be limited solely by the appended claims.

I claim:

1. A bowling ball lifting apparatus comprising:

a track;

a conveyor belt;

conveyor belt driving means including two conveyor belt pulleys for driving said conveyor belt in a direction substantially parallel to said track to move a bowling ball along the track by frictional engagement between the ball and the conveyor belt;

an elongated support member extending from one conveyor belt pulley to the other;

pulley mounting means for rotatably mounting said conveyor belt pulleys on said support member;

a bearing surface fixedly mounted on said support member;

cam means including an eccentric cam member mounted to and rotatable with a cam driving pulley for engaging said bearing surface;

pivot means for pivotably supporting said elongated support member; and means for rotating said cam driving pulley to cause said cam member to move said elongated support member in a pivotal path about said pivot means, said conveyor belt pulleys consequently oscillating towards and away from said track in a generally elliptical motion as said elongated support member pivots about said pivot means.

2. An apparatus as claimed in claim 1, wherein said pivot means is a rolling pivot mounted on a stationery frame, and said support member rests directly on said rolling pivot.

3. An apparatus as claimed in claim 1, further comprising a bracket fixedly mounted on said support member, said bracket comprising a bearing sleeve which includes said bearing surface, said eccentric cam extending through said sleeve and engaging said bearing surface.

4. An apparatus as claimed in claim 3, wherein said bracket is mounted on said support member between a lower one of said conveyor belt pulleys and said pivot means.

5. An apparatus as claimed in claim 3, wherein said bearing surface is circular.

6. An apparatus as claimed in claim 5, wherein said eccentric cam member is circular and fits within said sleeve.

7. An apparatus as claimed in claim 1, wherein said cam driving pulley is coaxially mounted on a shaft, and the center of said cam member is offset along a radius of said pulley from said shaft.

8. An apparatus as claimed in claim 1, wherein said means for rotating said cam driving pulley includes transmission means for causing said cam driving pulley to rotate in response to and in synchronism with rotation of one of said conveyor belt pulleys.

9. An apparatus as claimed in claim 8, wherein said transmission means includes a first transmission pulley and first drive belt means for causing said cam driving pulley to rotate in response to rotation of said first transmission pulley; a second transmission pulley mounted coaxially on and rotatable with said first transmission pulley, and second drive belt means for causing said second transmission pulley to rotate in response to rotation of said one of said conveyor belt pulleys, said second transmission pulley having a smaller diameter than said first transmission pulley.

10. An apparatus as claimed in claim 9, wherein said first drive belt means includes a single drive belt connected between said cam driving pulley and said first transmission pulley.

11. An apparatus as claimed in claim 9, wherein said second drive belt means includes a single drive belt connected between said second transmission pulley and a drive pulley mounted on and rotatable with said one of said conveyor belt pulleys.

12. An apparatus as claimed in claim 9, wherein said lifting apparatus further comprises a spherical cam mounted on and rotatable with said second transmission pulley; paddle means for preventing bowling pins from entering the lifting apparatus while permitting bowling balls to enter, one at a time, said paddle means including a paddle dimensioned to substantial cover openings in opposed frame members through which the bowling balls enter the lifting apparatus; and cam follower means for causing said paddle to oscillate between said openings in response to rotation of said spherical cam.

13. An apparatus as claimed in claim 1, further comprising means for driving one of said conveyor belt pulleys, said conveyor belt pulley driving means including a motor and a conveyor belt pulley drive belt connected between said motor and said conveyor belt pulley.

14. An apparatus as claimed in claim 1, wherein said track extends from an area below the level of a bowling alley to a position approximately level with or above the level of the bowling alley.

15. An apparatus as claimed in claim 1, wherein said track defines a generally S-shaped curvilinear pathway with a lower essentially horizontal ball receiving portion, and upper extending generally linear race, and an upward curved portion constructed and arranged for discharging a ball from the ball lifting apparatus.

16. An apparatus as claimed in claim 1, further comprising conveyor belt tension means for tensioning said conveyor belt, including an inner element and a sleeve slidably disposed on said inner element, a collar mounted on said inner element rearwardly of said sleeve, a coil spring surrounding said inner element and abutting said collar and a forward end of said sleeve, a pair of opposed longitudinal passages in said sleeve which are closed at each end thereof, and pin means fixed to said inner element and disposed in sliding engagement with said passages for limiting longitudinal and rotational movement of said inner element with respect to said sleeve.

17. A bowling bowl handling apparatus for use in conjunction with an automatic pin spotter, comprising a frame;

an elongated support member;

an eccentric shaft assembly;

a pair of rotatable pulleys disposed at each end of said elongated member;

an endless belt carried by said pair of pulleys for rotation therewith;

tension means for maintaining tension on said endless belt drive means for rotating one of said pulleys to cause said endless belt to move; upwardly extending track means adapted to receive a bowling ball thereon; and pivot means about which said elongated support member pivots in response to movement of said eccentric shaft assembly for positioning said endless belt in an upwardly extending position which is generally parallel with said track means and for causing ends of said elongated member to follow generally elliptical paths as said elongated member is moved by said eccentric shaft assembly so that said endless belt will engage a bowling ball disposed on said track and move the ball upwardly there along.

* * * * *